US005685550A

United States Patent [19]

Mayer, II

[11] Patent Number: 5,685,550

[45] Date of Patent: Nov. 11, 1997

[54] ROLLER SKATE WITH BRAKE

[76] Inventor: Bruce Allen Mayer, II, P.O. Box 145, Mendham, N.J. 07945

[21] Appl. No.: 472,382

[22] Filed: Jun. 7, 1995

[51] Int. Cl.[6] ..... A63C 17/00

[52] U.S. Cl. ..... 280/11.2; 280/11.22; 280/843

[58] Field of Search ..... 280/11.19, 11.2, 280/11.22, 11.23, 11.24, 11.26, 11.27, 11.28, 87.041, 87.042, 843

[56] References Cited

U.S. PATENT DOCUMENTS

| | | | |
|---|---|---|---|
| 2,166,767 | 7/1939 | Petermann | 280/11.22 |
| 3,936,061 | 2/1976 | Wada | 280/11.23 |
| 4,294,456 | 10/1981 | Tuell et al. | 280/11.28 |
| 4,618,158 | 10/1986 | Liberkowski | 280/11.26 |
| 4,838,564 | 6/1989 | Jarvis | 280/11.28 |
| 5,135,244 | 8/1992 | Allison | 280/11.28 |
| 5,199,727 | 4/1993 | Lai | 280/11.28 |
| 5,246,238 | 9/1993 | Brown | 280/11.27 |
| 5,312,165 | 5/1994 | Spletter | 280/11.2 |

*Primary Examiner*—Richard M. Camby
*Assistant Examiner*—Frank Vanaman
*Attorney, Agent, or Firm*—Barry Evans, Esq.; Curtis, Morris & Safford, P.C.

[57] ABSTRACT

A shaft extending in the skating directions is supported by stanchions depending from a boot plate. Spherical wheels formed by hemispherical segments are rotatably secured to the shaft in fixed axial position by a ring member having wing axles extending transversely the shaft axis, the ring member being rotatable about bearing members secured to the shaft. One Of the bearing members has a braking cam with a pair of oppositely positioned recesses which mate with a corresponding braking detent mechanism mounted in each wing axle. Each wheel segment is independently rotatably secured to a wing axle for rotation in the skating directions. The wing axles rotate with the wheels about the shaft in response to a stopping action transverse to the skating directions to provide a braking resistance in response to the detent mechanism riding against the cam surface. Different spring loads and springs are provided to allow for different skating stroke and stopping forces.

19 Claims, 3 Drawing Sheets

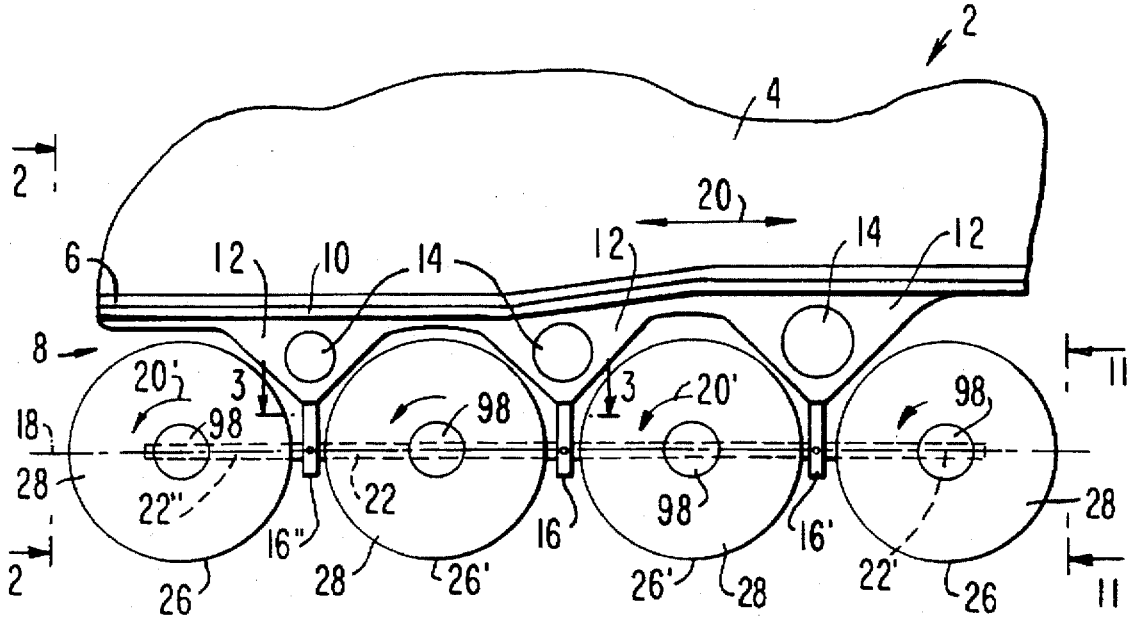
FIG. 1
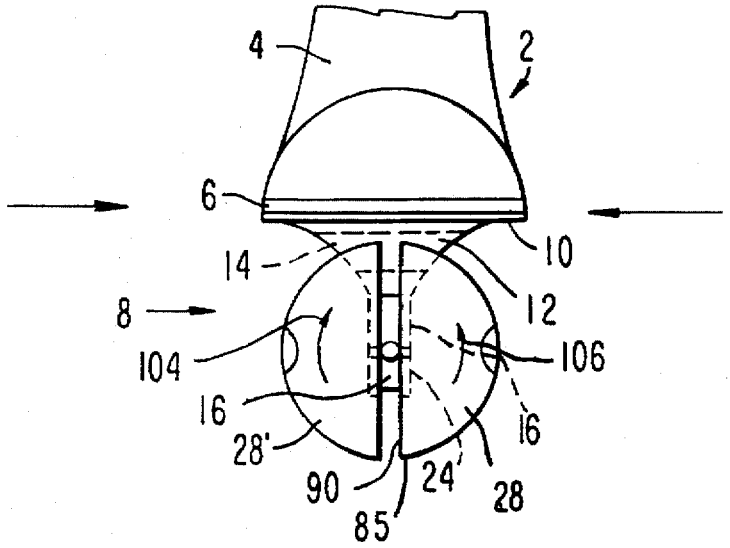
FIG. 2
FIG. 12
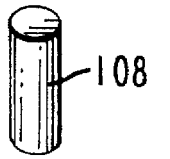
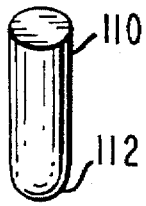
FIG. 13

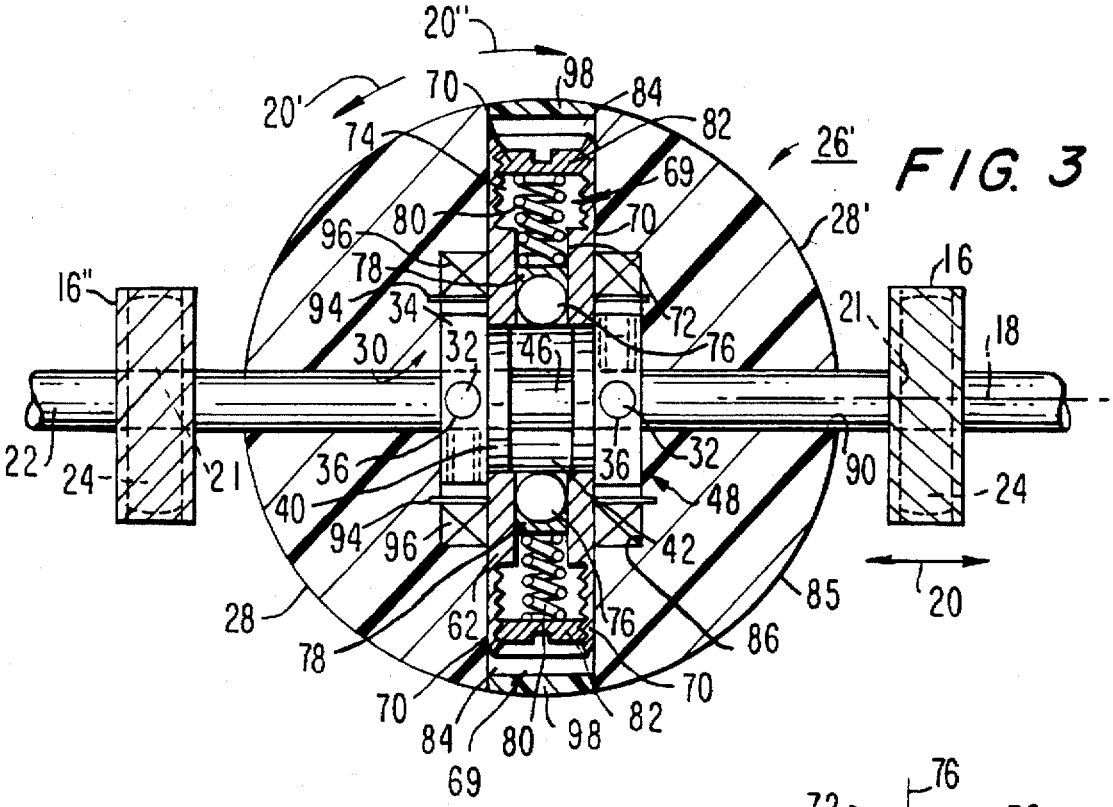
FIG. 3
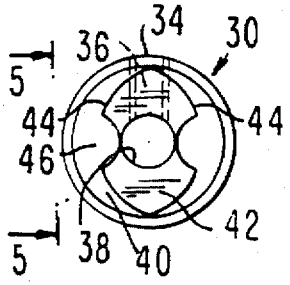
FIG. 4
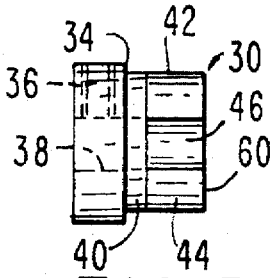
FIG. 5
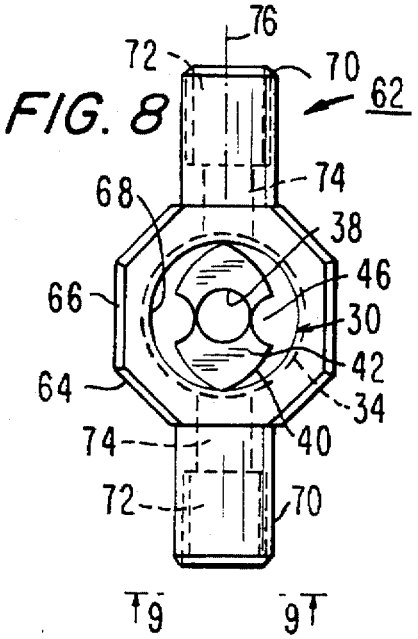
FIG. 8
FIG. 6
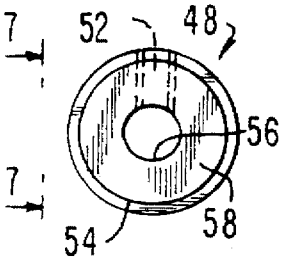
FIG. 7
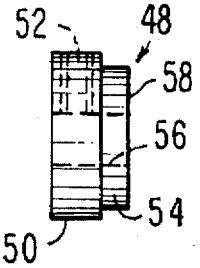
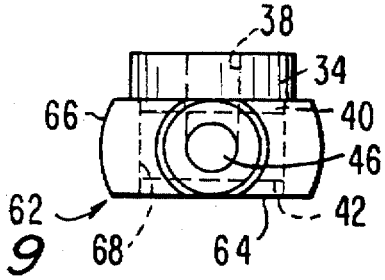
FIG. 9

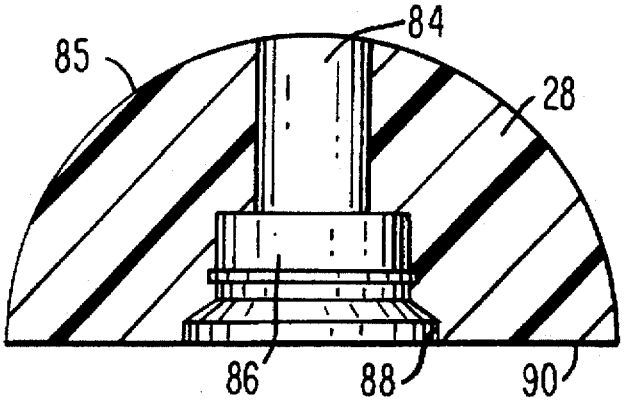
FIG. 10
FIG. 11
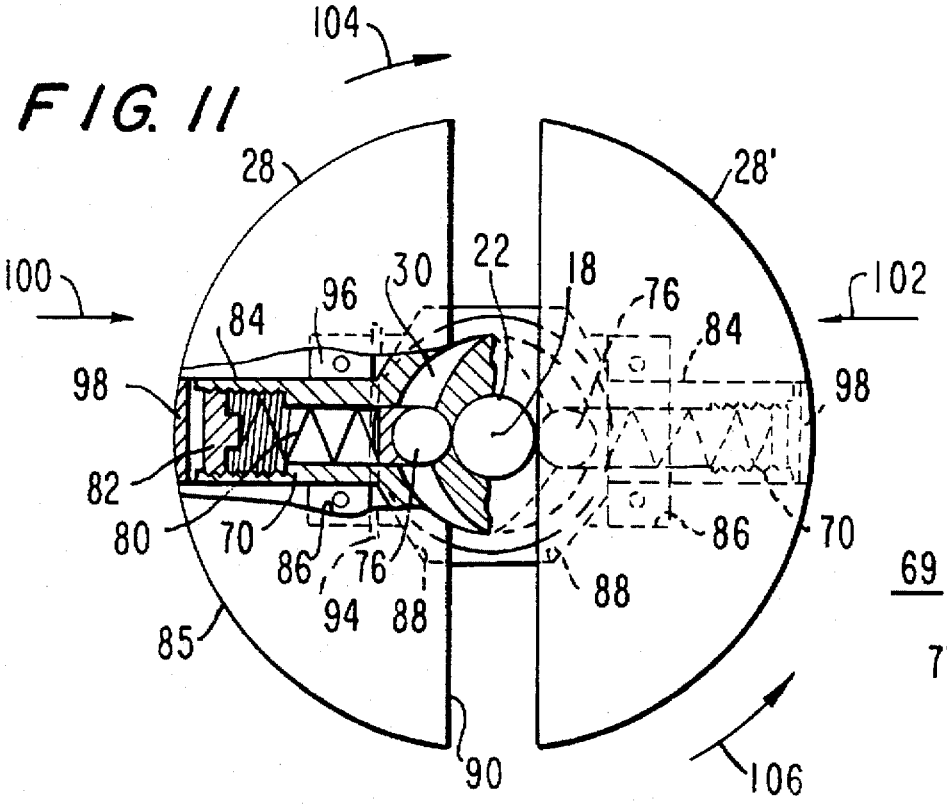
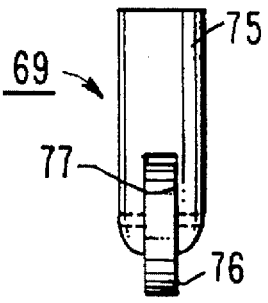
FIG. 14

ROLLER SKATE WITH BRAKE

This invention relates to roller skates of the type with a plurality of wheels aligned in a linear array with transverse acting braking arrangements.

Roller skates, particularly of the in-line type including a single linear array of wheels, are presently popular and in wide use. These skates tend to replicate ice skates. One problem with such skates, as with all roller skates, is including a provision of stopping. One widely used stopping device includes a rubber bumper at the front or rear of the skate wherein the skater abuts the bumper with the pavement for providing friction and resistance to the forward motion of the skater.

However, in ice skating, a popular way of stopping forward motion is known as the hockey stop. In a manner similar to the use of skis, the blade of the ice skate is turned transversely to the forward direction of the skater. The skate blade slides transversely in the forward direction and digs into the ice to provide stopping action. Some in-line roller skates utilize a braking device which attempts to duplicate the hockey stop.

One such braking device is disclosed in U.S. Pat. No. 4,618,158 issued to Liberkowski. In this patent an in-line skate is disclosed for use by figure skaters. Carrier yoke supports are rotatably secured to a mid-section support depending from a foot plate. The yoke supports rotate in a plane transverse to and about an axis parallel to the skaters foot in a toe to heel direction. A braking mechanism includes a non-round braking surface in an axial extension in a bearing stop secured to a housing rotatably secured to each yoke support. A spring and ball bearing abut the non-round surface to provide a retarding force to the rotation of the yoke supports as a function of the degree of rotation. Spatial wheel carrier yokes are on opposite ends of the yoke supports. Ball bearings rotatably receive main spherical rollers of the skate. Auxiliary rollers on opposite sides of the main rollers defining an extension of the surface of the main spherical rollers are attached to the spherical rollers.

When the main rollers rotate about a horizontal front to rear axis in a hockey stop motion in a transverse direction, the auxiliary rollers, which are barrel shaped, contact the ground and support the skate. The rotation in this transverse direction activates the braking action to resist the forward motion of the skater. The auxiliary rollers can only roll in a front to rear direction of the velocity moment of the skater. This skate is relatively complex, limits the number of wheels that can be used and is relatively costly to fabricate.

A brake and wheel for in-line roller skates is also disclosed in U.S. Pat. No. 5,312,165 to Spletter. This construction uses slip discs on a retainer ring forming the skate wheels. The discs provide a transverse braking skid, providing a rotatable friction engagement with the main support structure while the skate moves in the transverse direction.

U.S. Pat. No. 5,246,238 discloses a roller skate wheel for providing rolling action in forward and lateral directions. The main rollers are provided with secondary rollers which rotate about axes transverse to the axis of rotation of the main rollers. Metal friction applying brakes contact the secondary rollers. The friction applied to the secondary rollers controls resistance to lateral rolling to provide a braking action.

Other skate and wheel constructions are disclosed in U.S. Pat. Nos. 5,199,727; 5,135,244; 4,838,564; 4,294,456; 3,936,061 and 2,166,767.

The present inventor recognizes a need for a simplified roller skate construction with a braking mechanism for generating a stopping action similar to a hockey stop. A need is recognized for a braking device that is self contained in each wheel and which applies a settable braking load according to the weight of a skater.

A roller skate construction according to the present invention having at least one wheel attachable to a foot receiving boot having a toe and heel defining forward and rearward skating directions, the at least one wheel for normally rotating in the skating directions, comprises support means for attachment to the boot. At least one wheel comprises at least one segment and having at least one surface substantially defining a surface of revolution in at least two orthogonal directions. Axle means include an axle having an axis extending transversely the skating directions and rotatably secured to the support means for rotation in a first angular direction in a plane transverse the skating directions. Bearing means are included for rotatably securing the at least one wheel to the axle for rotation in the skating directions.

In one embodiment, brake means are coupled to the support means and to the axle means for impeding the rotation of the axle means in the first angular direction to provide a brake load in the first angular direction.

In a further embodiment, the brake means comprise means for providing a progressively increasing braking resistance to the axle means as the axle means rotates from a neutral position.

In a still further embodiment, the brake means include a cam secured to the support means and resilient means secured to the axle means for engaging the cam and responsive to the relative rotation of the axle means in the first angular direction for providing the braking resistance.

In a further embodiment, the support means comprise a shaft having an axis extending in the skating directions and a first bearing secured to the shaft in fixed position to the shaft for rotatably securing the axle means including the axle thereto for rotation in the first angular direction about the axis.

In an additional embodiment, the axle means comprises a ring member having a bore rotatably receiving the first bearing for rotation about the shaft axis and the axle comprises a pair of wing axles extending in opposite directions from the ring member, the bearing means including a wheel bearing secured to each wing axle for rotatably receiving at least one wheel segment.

IN THE DRAWING

FIG. 1 is a fragmented side elevation view of a roller skate according to an embodiment of the present invention;

FIG. 2 is a front end elevation view of the roller skate of FIG. 1 taken along lines 2—2:;

FIG. 3 is a sectional view of a wheel of FIG. 1 taken along lines 3—3 with the wheel rotated to a braking position;

FIG. 4 is a front elevation view of a bearing and cam member used in the embodiment of FIG. 3;

FIG. 5 is a side elevation view of the bearing and cam member of FIG. 4;

FIG. 6 is a front elevation view of a second bearing member of FIG. 3;

FIG. 7 is a side elevation view of the bearing member of FIG. 6;

FIG. 8 is a front elevation view of a ring axle member and bearing and cam member used in the embodiment of FIG. 3;

FIG. 9 is an end elevation view of the embodiment of FIG. 8 taken along lines 9—9;

FIG. 10 is a sectional view through one wheel segment;

FIG. 11 is an end elevation view partially in section of the embodiment of FIG. 1 taken along lines 11—11;

FIG. 12 is an isometric view of a compressible member used in an alternative embodiment of the detent arrangement of FIG. 3;

FIG. 13 is an isometric view of a detent member used in an alternative embodiment of the detent arrangement of FIG. 3; and FIG. 14 is a side elevation view of a roller plunger employed in the embodiment of FIG. 3.

In FIGS. 1 and 2, roller skate 2 comprises a foot receiving boot 4 having a sole 6 to which roller assembly 8 is attached. Assembly 8 comprises a preferably thermoplastic sole plate 10 which may also be metal for attachment to sole 6 by rivets, for example. A linear array of three generally conical support stanchions 12 but with rounded surfaces depend from and are secured to plate 10 having holes 14 to lighten the structure. A linear array of three supports 16, 16' and 16" depend from and are integral with the stanchions 12, each support corresponding to a different stanchion. The supports 16—16" are generally rectangular in transverse section. The stanchions 12 and supports 16—16" may be molded of high strength engineering plastics such as ULTEM a trademark of the General Electric Company or metal if desired. The array of stanchions 12 are aligned in the axial toe to heel directions 20 of the boot 4 parallel to axis 18. The supports 16—16'" have aligned bores 21 defining axis 18 which extends in the heel to toe skating directions.

A circular cylindrical preferably metal, e.g., hardened steel, shaft 22 which may also be thermoplastic with reinforcing carbon fibers for example is secured to the supports 16—16" in bores 21 by press fit pins 24 (FIG. 3). In the alternative, screws (not shown) may also secure the shaft 22 to the supports 16. An array of four identical wheel assemblies 26, 26' are attached to the shaft 22. Each intermediate wheel assembly 26' is between two adjacent supports 16, 16' and 16, 16". The end wheel assemblies 26 are secured to a cantilevered portion of the shaft 22. For example, the rear wheel assembly 26 is attached to cantilevered shaft 22 portion 22' which is cantilevered from support 16'. The front wheel assembly 26 is attached to cantilevered shaft portion 22" cantilevered from support 16".

Each wheel assembly 26, 26' comprises two mating identical partial hemispherical segments 28 and 28'. The partial hemispherical segments 28 and 28' are spaced apart a distance slightly greater than the diameter of the shaft 22 to permit rotation of the segments and together substantially form a sphere, as best seen in FIGS. 2, 3 and 11. The partial hemispherical segments 28 and 28' are preferably molded polyeurethane. The surface of the hemispherical segments may be smooth as such material provides sufficient friction for engaging a pavement being rolled upon. A roughened surface may be provided if desired to enhance the pavement gripping action. Other materials as known may be used in the alternative.

In FIG. 3, a bearing and cam member 30, preferably molded thermoplastic, but could also be brass or steel, is attached in fixed relationship to shaft 22 by screw 32. In FIGS. 4 and 5, the cam member 30 has a circular cylindrical flange 34 with a threaded radial bore 36 for receiving screw 32. The member 30 has an axial through bore 38 for receiving shaft 22 therethrough. A smaller diameter circular cylindrical bearing 40 extends from and coaxial with flange 34.

A symmetrical eye shaped cam 42 in plan view, FIG. 4, extends from symmetrical and coaxial with bearing 40. Cam surfaces 44 on opposite sides of the cam 42 are both circular segments each formed by an identical radius, and are spaced in mirror image relation. The cam surfaces 44 may be other mirror image shapes as determined by a given implementation. For example, the surfaces 44 may be planar in the alternative to form a diamond shape in end view similar to the view of FIG. 4. A circular cylindrical segment recess 46 is formed centrally diametrically opposite each other in each surface 44. The recess 46 is parallel to bore 38.

In FIGS. 3 and 6–7, a second bearing member 48, preferably molded thermoplastic but could be brass or steel, has a circular cylindrical flange 50 with a radial threaded bore 52 for receiving a screw 32. Flange 50 is the same diameter as flange 34. The bearing member 48 has a circular cylindrical bearing 54 coaxial with and extending from flange 50. The bearing 54 is the same diameter as bearing 40. A through bore 56 receives the shaft 22 therethrough. Member 48 is fastened to the shaft by a screw 32. The bearing 54 has a face 58 which abuts the face 60 of cam member 30 cam 42. The two bearings 40 and 54 of cam member 30 and bearing member 48 respectively form a single bearing surface for rotatably receiving ring member 62, FIGS. 3, 8 and 9.

Ring member 62, preferably molded thermoplastic, but could be steel or other metal, comprises a ring 64 which is circular cylindrical in plan view, FIG. 8. Ring 64 has a circular cylindrical bore 68 for rotatably receiving bearings 40 and 54 of members 30 and 48, respectively. The ring 64 is assembled to the shaft 22 between the cam member 34 and bearing member 48 before they are attached by screws 32 to the shaft 22. The flanges 34 and 50 capture the ring 64 therebetween.

Ring member 62 includes two identical and mirror image wing axles 70 which extend from ring 64 in opposite directions. Axles 70 are circular cylinders with a larger diameter threaded bore 72 in communication with one end of the axle and coaxial with a reduced diameter bore 74 on axis 76. Bore 74 is in communication with bore 68 at the axle other end. The axles 70 are each threaded externally with threads 73.

In FIGS. 3 and 11, screws 32 (or pins, not shown) secure the cam member 30 and bearing member 48 to shaft 22 capturing the ring 64 of ring member 62 therebetween. The ring member 62 is free to rotate on and about the bearings 40 and 54 and axis 18.

A detent mechanism 69 with a predetermined resilient load is in each wing axle 70. The mechanism 69 includes a circular cylindrical preferably metal plunger 75, FIG. 14, having a slot 77. A steel wheel 76 is rotatably secured to the plunger in slot 77. The plunger 75 is located in each bore 72 of each wing axle 70, FIG. 3. A spring 80 is in each bore 72 and 74 of each wing axle and engages a respective plunger 75. A screw 82 is threaded to each bore 72 to secure the spring 80 and plunger 75 in the bores 72 and 74 of the wing axles.

Each wheel 76 (FIG. 14) of the detent mechanism 69 normally rests in a corresponding recess 46 on opposite sides of the cam 44 of the cam member 30. This position defines the normal neutral quiescent position of the cam member 30.

In FIG. 10, a representative wheel partial hemispherical segment 28, which is identical to all wheel partial hemispherical segments, has a through bore 84 in communication with the spherical surface 85. Bore 84 has an enlarged diameter inner stepped first bore 86 and further enlarged diameter stepped outer bore 88 in communication with the planar side surface 90 of the wheel hemispherical segment 28. A metal circular cylindrical sleeve 91 is press fit in the bore 86. An annular groove 92 is in the sleeve 91 for receiving a retaining ring 94 (FIG. 3).

In FIG. 3, retaining ring 94 secures a ball bearing assembly 96 in the bore of sleeve 91 of each wheel hemisphere 28, 28'. Each ball bearing 96 has an inner race which is slid over a corresponding wing axle 70 to rotatably secure the axle to the bearing. A ring nut 81 is threaded to the external threads 73 of each wing axle 70 to secure the bearing assemblies 96 to the corresponding wheel hemisphere. Thus the nuts 81 secure the bearing assemblies 96 to the wing axles and retaining rings 94 secure the bearing assemblies to each of the wheel partial hemispheres. The enlarged bore 88 forms a cavity which receives the ring 64 of ring member 62. A thermoplastic plug 98, FIG. 3, seals the open end of bore 84.

To assemble the wheels 26, 26', the shaft 22 is slid through each stanchion bore 21. The appropriate cam member 30, bearing member 48 with the ring member 62 assembled thereto are placed on the shaft 22 between stanchions. When the shaft is fully inserted the cam member 30 and bearing member 48 are fastened to the shaft 22 by the screws 32 fixing them to the shaft. This secures the ring member 62 and its assembled components to the cam member 30 and bearing member 48 for rotation relative thereto about axis 18. The ring member 62 has the detent mechanism 69 previously fully assembled to each wing axle 70.

Because of the eye shape of the cam 42, the detent mechanism 69 springs force the corresponding detent wheels 76 into one of the cam 42 recesses 46 in the free state placing the ring member 62 in its normal neutral quiescent position, FIG. 11. This is because the cam member cam surface 44 produces the least force on the detent wheel 76 when the wheel 76 is in a recess 46. These detent forces rotate the cam member 30 until each wheel 76 is seated in one of the recesses 46. The wheel 76 meets increasing resistance as the cam surface 44 rotates relative thereto. The cam member 30 being symmetrical, permits a wheel 76 to seat in either of the two recess 46 on opposite sides of the cam member cam 42. Thus the cam member has two opposite quiescent neutral positions.

In operation, each wheel 26, 26' partial hemispherical segment 28, 28' is free to rotate independently on its corresponding bearing assembly 96. In use, the normal neutral position of the wheels 26, 26' is shown in FIGS. 1, 2 and 11. In this position, the wheels rotate in the forward or rearward toe to heel skating directions 20, FIG. 1. When it is desired to stop, the skater turns the direction of the skate 2 so that it is transverse to the direction of motion, one of directions 20, of the skater. As a result, the skater and skate 2 is moving in one of directions 100 or 102, FIG. 11 transverse to directions 20 which are parallel to axis 18.

Motion in directions 100 or 102 causes the wheels 26 to rotate in a direction 104 or 106, respectively, about axis 18. This rotation is permitted by the rotation of the ring member 62 and the wing axles 70 in these directions about the bearing member 48 and cam member 30 bearings. As the ring member 62 rotates, the detent mechanism 69 on each wheel segment escapes the corresponding detent recess 46 and meets increasing resistance to rotation due to the eye shape of the cam 42. If this resistance does not stop the skate motion, further repetitive rotations reproduce such resistances until the skate stops. At this time the skater lifts the skate from the pavement and the wheels automatically return to their neutral positions as discussed above.

Different spring loads can be provided to accommodate different skater weights. Such loads are provided by providing springs of different spring rates. Further, different spring configurations of different spring rates can be interchanged to accommodate such different skater weights. Also, during skating, each skater exerts a transverse load onto the wheels during each skating stroke. Such loads will vary from skater to skater. For example, a small child will exert a much smaller stroke and stopping load than a heavy adult. The detent loads should be sufficiently great to preclude premature rotation of the wheels about axis 18 during such skating strokes regardless the forces exerted. Therefore, different springs of different spring rates accommodate such a need.

In the alternative to a relatively stiff coil metal spring 80, preferably other spring configurations may be used. For example, in FIG. 12, rod 108 of thermosetting material, e.g., Vibrathane, a trademark of Uniroyal company, is employed in place of spring 80, FIG. 3. This plastic material is compressible and provides a resilient load when compressed. This material may exhibit permanaent deformation. However, this deformation is reduced or eliminated by adding components to the material as known by one of ordinary skill in the thermosetting plastic art. Rods of different spring rates are provided to accommodate different anticipated loads. For example, different springs whether coil or rod, may be provided as a kit to accompany the skates so that the appropriate spring may be used according to a given implementation.

The length and diameter of the rods 108 and coil springs 80 as well as their material may also differ to provide such different spring rates. A balance need be provided between allowing for stroke forces without disengaging the braking detent mechanism 69 from the detent recesses 46 while permitting such braking disengagement when stop action is desired. Such forces can be determined empirically.

In FIG. 13, in the alternative to a plunger-wheel detent such as plunger mechanism 69, FIG. 14, a plunger 110 may be used. The plunger 110 has a spherical end 112 for engaging a recess 46. The plunger may be molded thermoplastic or metal. The plunger is axially displaced toward a recess 46 by the spring 80. Also, in the alternative, a ball-plunger detent mechanism may be provided.

While four wheels have been shown in the illustrated embodiment more or fewer wheel can be provided. The important aspect is that each wheel has a self contained braking mechanism and, therefore, is substantially independent of the skate construction, notwithstanding the need for a shaft such as shaft 22. Shafts 22 of different lengths and strengths are provided according to a given implementation.

The wheels may be small in diameter and still accommodate the braking mechanism. The greater the number of wheels the greater the stopping forces created for a given braking mechanism. Therefore, for a skate using a large number of wheels the stopping load can be set by employing dummy wheels without the detent mechanism 69 where a relatively smaller stopping load is needed. A greater stopping load can be provided by increasing the number of wheels used for a given brake mechanism. The wheels need not be between two adjacent stanchions as each wheel is fixed to the shaft 22 independently of the stanchions.

The cantilevered shaft 22 portions 22" serve an important function. When a skater applies pressure to the rear or front wheels, the shaft portions 22" bend slightly and provide a spring effect to these wheels. This provides a catapult effect for the skater as the skater applies the pressure to these wheels during skating strokes This effect provides additional speed to the skater.

It will occur to one of ordinary skill that still further modifications may be made to the disclosed embodiments without departing from the spirit and scope of the present invention as defined in the appended claims. The disclosed embodiments are given by way of illustration and not limitation.

What is claimed is:

1. A roller skate construction having at least one wheel attachable to a foot receiving boot having a toe and heel defining forward and rearward skating directions, said at least one wheel for normally rotating in said skating directions, said construction comprising:

support means for attachment to said boot;

at least one wheel comprising at least one segment and having at least one surface substantially defining a surface of revolution in at least two orthogonal directions;

axle means including an axle within said wheel having an axis extending transverse to said skating directions and rotatably secured to the support means for rotation in a first angular direction in a plane transverse to the skating directions;

bearing means for rotatably securing said at least one wheel to said axle for rotation in said skating directions;

said support means comprising a shaft having an axis extending in said skating directions and a first bearing member secured to said shaft in a fixed position to said shaft for rotatably securing said axle means including said axle thereto for rotation in said first angular direction about said axis; and said axle means comprising a ring member having a bore rotatably receiving said first bearing for rotation about said shaft axis and said axle comprises a pair of wing axles extending in opposite directions from said ring member, said bearing means for rotatably securing said at least one wheel including a wheel bearing secured to each wing axle for rotatably receiving said at least one wheel.

2. The construction of claim 1 including brake means for impeding the rotation of said axle means in said first angular direction to provide a brake load in said first angular direction.

3. The construction of claim 2 wherein said brake means comprises means for providing a progressively increasing braking resistance to said axle means as said axle means rotates from a neutral position.

4. The construction of claim 3 wherein said brake means includes a cam secured to said support means and resilient means secured to said axle means for engaging said cam and responsive to the rotation of said axle means in said first angular direction for providing said braking resistance.

5. The construction of claim 1 wherein the support means includes a plurality of depending support members and a shaft having an axis extending in said skating directions secured to said support members, said construction including a plurality of said wheels, at least one of said plurality of wheels being secured to an end of said shaft in cantilevered relation to a support member.

6. The construction of claim 1 wherein said axle means includes & pair of axles, said wheel comprising two substantially semi-spherical segments forming a substantially spherical wheel, each segment being rotatably secured for rotation in said skating directions independently.

7. The construction of claim 1 including a plurality of said first bearings secured to the shaft in fixed spaced relation, each first bearing including a ring member and associated wing axle with each rotatably secured to a different respective one of said first bearings, and a wheel secured to each wheel bearing.

8. The construction of claim 1 including brake means for impeding the rotation of said wing axles about said first bearing in said first angular direction.

9. The construction of claim 8 wherein said brake means comprises cam means for providing a progressively increasing braking resistance to said wing axles as said wing axles rotate.

10. The construction of claim 9 wherein the cam means includes means for selectively providing a resistance value in a range of values to provide a settable braking load.

11. The construction of claim 9 wherein said means for providing a resistance value includes resilient detent means mounted in each wing axle and in contact with said cam means, said cam means including at least one recess in a surface thereof for receiving said detent means, said cam means having a surface configuration arranged with said detent means and recess as to form a normal quiescent position of said ring member with the cam means.

12. The construction of claim 8 wherein the brake means comprises a cam member fixedly secured to the first bearing, each wing axle having a hollow core for receiving resilient detent means for engaging said cam member.

13. The construction of claim 12 wherein the detent means includes a compressible rod for providing a given spring load on said cam member.

14. A roller skate construction having at least one wheel attachable to a foot receiving boot having a toe and heel defining forward and rearward skating directions comprising:

support means for attachment to said boot;

a shaft secured to the support means having an axis extending in said skating directions;

a substantially spherical wheel defining a peripheral surface; and bearing and axle means secured to the shaft and wheel and contained substantially within the wheel peripheral surface for rotatably securing said wheel relative to the shaft for rotation in two orthogonal directions perpendicular to each other.

15. The construction of claim 14 including brake means for providing a progressively increasing braking resistance to said wheel as said wheel rotates in a direction perpendicular to said skating directions.

16. The construction of claim 15 wherein said bearing and axle means includes at least one axle defining an axis for said rotation in said skating directions and, said at least one axle is mounted for rotation in said direction perpendicular to said skating directions, said brake means including a cam fixedly secured to said shaft and resilient means secured to said at least one axle for engaging said cam and responsive to the relative rotation of said one axle to said cam for providing said braking resistance.

17. The construction of claim 16 wherein the resilient means comprises one of a compressible rod and spring resilient load on a plunger-wheel detent means and a recess in said cam for receiving said resilient means in one angular position of the cam relative thereto, said cam having a surface arranged to automatically force the detent means into said recess in a free state in response to providing progressively increasing resistance to the rotation of said at least one axle as the at least one axle rotates.

18. The construction of claim 14 wherein the wheel comprises two generally semi-spherical halves each rotatably secured for independent rotation in said skating directions and for rotation in unison in said direction perpendicular to said skating directions.

19. A roller skate construction having at least one wheel attachable to a foot receiving boot having a toe and heel defining forward and rearward skating directions, said at least one wheel for normally rotating in said skating directions, said construction comprising:

support means including at least one depending support member for attachment to said boot;

a shaft extending in said skating directions secured to said support member;

a plurality of like wheels each comprising two segments arranged to independently rotate in planes parallel to said skating directions and each having at least one surface substantially defining a surface of revolution in at least two orthogonal directions;

a plurality of bearings secured to the shaft, each bearing corresponding to a different wheel;

axle means including a ring member secured to each bearing for rotation about said shaft and a pair of wing axles secured to each ring member and having coaxial axes extending transversely to said skating directions;

bearing means secured to each wing axle for rotatably receiving a different wheel segment of said two segments and forming said two wheel segments into a single wheel; and brake means including a cam and resilient detent means secured to each wing axle to contact a surface of said cam, said cam and detent means being arranged to provide progressively increasing resistance to the rotation of said wing axles and associated ring member about said shaft from a neutral position.

* * * * *